US007618243B2

(12) United States Patent
Tian et al.

(10) Patent No.: US 7,618,243 B2
(45) Date of Patent: Nov. 17, 2009

(54) LINEAR COMPRESSOR CONTROLLER

(75) Inventors: Zhuang Tian, Auckland (NZ); John H. Boyd, Jr., Holland, MI (US)

(73) Assignee: Fisher & Paykel Appliances Limited, Auckland (NZ)

( * ) Notice: Subject to any disclaimer, the term of this patent is extended or adjusted under 35 U.S.C. 154(b) by 139 days.

(21) Appl. No.: 11/393,225

(22) Filed: Mar. 30, 2006

(65) Prior Publication Data

US 2007/0095073 A1 May 3, 2007

(30) Foreign Application Priority Data

Apr. 19, 2005 (NZ) ..... 539554
Jul. 25, 2005 (NZ) ..... 541464

(51) Int. Cl.
*F04B 17/04* (2006.01)

(52) U.S. Cl. ..... 417/417; 417/44.11

(58) Field of Classification Search ..... 417/44.1, 417/415, 412, 53, 44.11, 12, 417; 62/6, 228.1; 318/135, 127; 310/12, 15, 30, 13; 91/361; 92/60.5

See application file for complete search history.

(56) References Cited

U.S. PATENT DOCUMENTS 5,496,153 A * 3/1996 Redlich ..... 417/212
6,176,683 B1 * 1/2001 Yang ..... 417/44.1
6,437,524 B1 * 8/2002 Dimanstein ..... 318/135
6,536,326 B2 3/2003 Unger et al.
6,663,348 B2 * 12/2003 Schwarz et al. ..... 417/12
6,809,434 B1 10/2004 Duncan et al.
6,812,597 B2 11/2004 McGill et al.
6,960,893 B2 * 11/2005 Yoshida et al. ..... 318/127
2003/0099550 A1 * 5/2003 Kim ..... 417/44.11
2004/0005222 A1 * 1/2004 Yoshida et al. ..... 417/44.11

* cited by examiner

*Primary Examiner*—Devon C Kramer
*Assistant Examiner*—Amene S Bayou
(74) *Attorney, Agent, or Firm*—Trexler, Bushnell, Giangiorgi, Blackstone & Marr, Ltd.

(57) ABSTRACT

A free-piston linear compressor (1) controlled to achieve high volumetric efficiency by a controller including an algorithm (116) for ramping up input power until piston-cylinder head collisions are detected using a detection algorithm (117/118) which then decrements power input whereupon input power is again ramped up by algorithm (116). Non-damaging low energy collisions are achieved by the controller including a perturbation algorithm (119) which perturbates the input power ramp with periodic transient pulses of power to ensure piston collisions are provoked during the transient power pulses.

20 Claims, 6 Drawing Sheets

LINEAR COMPRESSOR CONTROLLER

CROSS-REFERENCE TO RELATED APPLICATION

Priority to New Zealand 539554 filed on Apr. 19, 2005 and New Zealand 541464 filed on Jul. 25, 2005 is claimed.

FIELD OF INVENTION

This invention relates to a system of control for a free piston linear compressor and in particular, but not solely, a refrigerator compressor. The control system allow a high power mode of operation in which piston stroke is maximised and collisions deliberately occur.

PRIOR ART

Linear compressors operate on a free piston basis and require close control of stroke amplitude since, unlike conventional rotary compressors employing a crank shaft, stroke amplitude is not fixed. The application of excess motor power for the conditions of the fluid being compressed may result in the piston colliding with the head gear of the cylinder in which it reciprocates.

U.S. Pat. No. 6,809,434 discloses a control system for a free piston compressor which limits motor power as a function of a property of the refrigerant entering the compressor. However in linear compressors it is useful to be able to detect an actual piston collision and then to reduce motor power in response. Such a strategy can be used purely to prevent compressor damage, when excess motor power occurs for any reason or, can be used as a way of ensuring high volumetric efficiency by gradually increasing power until a collision occurs and then decrementing power before gradually increasing power again. The periodic light piston collisions inherent in this mode of operation cause negligible damage and can easily be tolerated.

U.S. Pat. No. 6,536,326 discloses a system for detecting piston collisions in a linear compressor which uses a vibration detector such as a microphone.

U.S. Pat. No. 6,812,597 discloses a method and system for detecting piston collisions based on the linear motor back EMF and therefore without the need for any sensors and their associated cost. This uses the sudden change in period that has been found to occur on a piston collision. Reciprocation period and/or half periods can be obtained from measuring the time between zero-crossings of the back EMF induced in the motor stator windings. The back EMF is a function of motor armature velocity and therefore piston velocity and zero-crossings indicate the points when the piston changes direction during its reciprocation cycles.

When it is desired deliberately to run the compressor at maximum power and high volumetric efficiency it is very important to ensure the collision detection system does not miss the onset of collisions as they will be a regular and expected occurrence in this mode of operation and successive collisions with increasing power will cause damage.

SUMMARY OF THE INVENTION

It is an object of the present invention to provide a control system for a free-piston linear compressor which allows for high power operation while obviating piston collision damage.

Accordingly in a first aspect the invention consists in a method of controlling a free-piston linear compressor comprising:

(a) providing a gradually increasing input power function to the compressor;
(b) superimposing a transient power function with the power function of step (a) to momentarily increase the input power to the compressor;
(c) monitoring for piston collisions; and
(d) when a piston collision is detected immediately decrementing said input power.

In a further aspect the invention consists in a method of controlling a linear compressor which includes a free piston reciprocating in a cylinder driven by an electric motor having a stator with one or more excitation windings and an armature connected to said piston comprising the steps of:

(a) supplying an alternating current to said stator winding to cause said armature and piston to reciprocate,
(b) obtaining an indicative measure of the reciprocation period of said piston,
(c) detecting any sudden reduction of said indicative measure, said sudden reduction indicative of a piston collision with the cylinder head,
(d) gradually increasing the power input to said stator windings over many reciprocation periods,
(e) superimposing a transient increase in power with the gradually increasing stator power, and
(f) reducing the power input to said stator windings on detecting any sudden decrease in piston period.

In yet a further aspect the invention consists in a method of controlling a linear compressor which includes a free piston reciprocating in a cylinder driven by an electric motor having a stator with one or more excitation windings and an armature connected to said piston comprising the steps of:

(a) supplying an alternating current to said stator winding to cause said armature and piston to reciprocate,
(b) monitoring the motor back EMF,
(c) detecting zero-crossings of said motor back EMF,
(d) monitoring the slope of the back EMF waveform in the vicinity of said zero-crossings,
(e) detecting discontinuities in said waveform slope, said discontinuities indicative of a piston collision with the cylinder head,
(f) gradually increasing the power input to said stator windings over many reciprocation periods,
(g) superimposing a transient increase in power with the gradually increasing stator power, and
(h) reducing the power input to said stator windings on detecting any back EMF slope discontinuity.

In a further aspect the invention consists in a free piston gas compressor comprising:

a cylinder,
a piston,
said piston reciprocable within said cylinder,
a reciprocating linear electric motor coupled to said piston,
a control system configured to monitor motor back, EMF for an indication of piston collisions and
set the power input to said motor accordingly,
said control system gradually increasing the power input to said motor in the absence of piston collision and rapidly reducing the power input to said motor if a collision is detected,
in the absence of piston collision said control system superimposing transient power increases with said gradually increasing power input to induce a low energy collision when said piston is near maximum displacement.

In a further aspect the invention consists in a free piston gas compressor comprising:

a cylinder,
a piston reciprocally received within the cylinder, an electric motor coupled to the piston, and a control system configured to control reciprocation of the piston by:

(a) gradually increasing input power to the electric motor to cause the piston to reciprocate with increasing displacement;

(b) superimposing a transient increase in power with the gradually increasing input power of step (a) to momentarily increase piston displacement;

(c) monitoring piston collisions, and (d) when a piston collision is detected immediately decrementing said input power.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DESCRIPTION OF THE PREFERRED EMBODIMENTS

The present invention relates to controlling a free piston reciprocating compressor powered by a linear electric motor. A typical, but not exclusive, application would be in a refrigerator.

Figure 1:
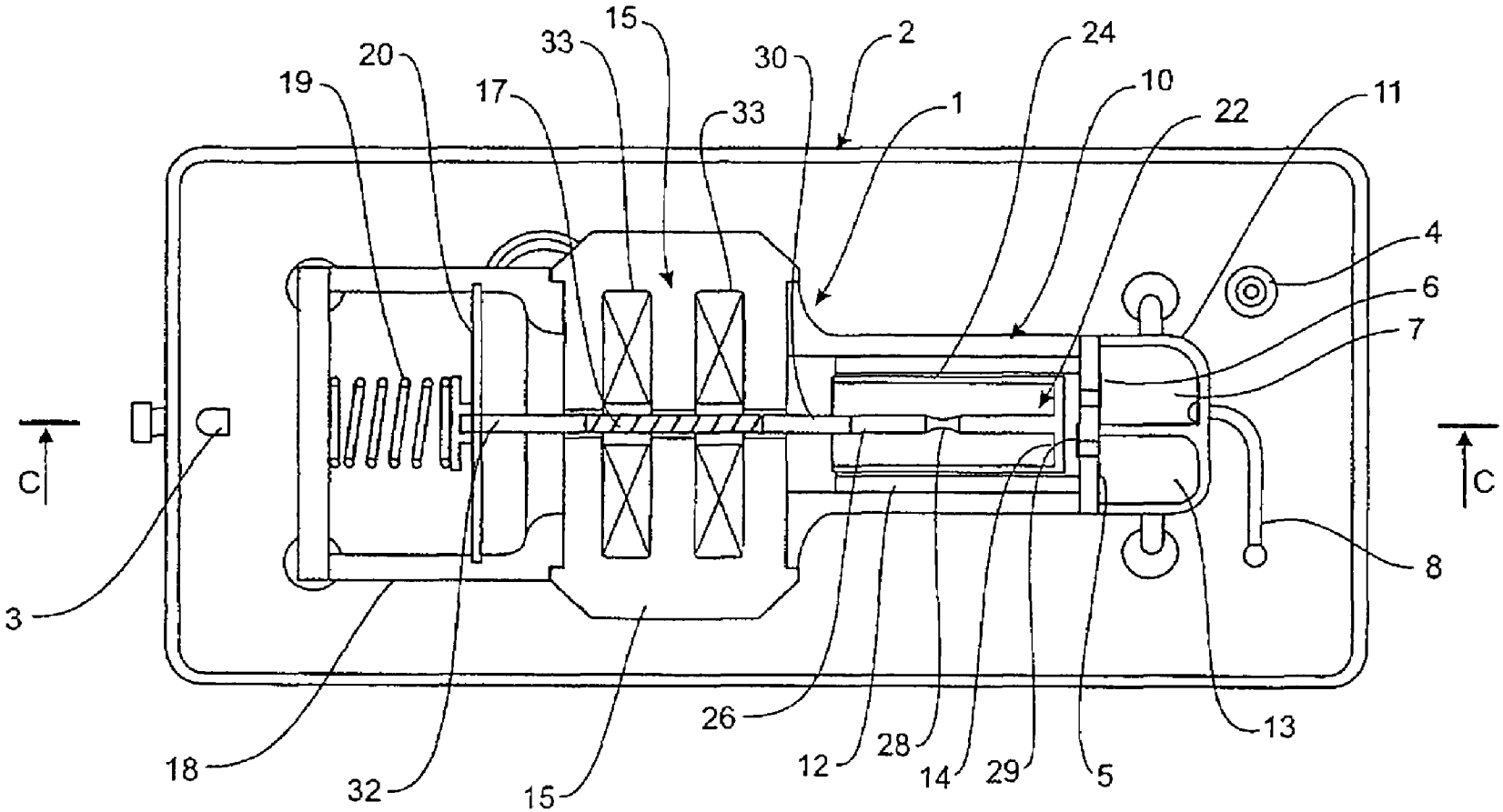
FIG. 1 is a longitudinal axial-section of a linear compressor controlled according to the present invention.

By way of example only and to provide context a free piston linear compressor which may be controlled in accordance with the present invention is shown in FIG. 1.

A compressor for a vapour compression refrigeration system includes a linear compressor 1 supported inside a shell 2. Typically the housing 2 is hermetically sealed and includes a gases inlet port 3 and a compressed gases outlet port 4. Uncompressed gases flow within the interior of the housing surrounding the compressor 1. These uncompressed gases are drawn into the compressor during the intake stroke, are compressed between a piston crown 14 and valve plate 5 on the compression stroke and expelled through discharge valve 6 into a compressed gases manifold 7. Compressed gases exit the manifold 7 to the outlet port 4 in the shell through a flexible tube 8. To reduce the stiffness effect of discharge tube 8, the tube is preferably arranged as a loop or spiral transverse to the reciprocating axis of the compressor. Intake to the compression space may be through the head, suction manifold 13 and suction valve 29.

The illustrated linear compressor 1 has, broadly speaking, a cylinder part and a piston part connected by a main spring. The cylinder part includes cylinder housing 10, cylinder head 11, valve plate 5 and a cylinder 12. An end portion 18 of the cylinder part, distal from the head 11, mounts the main spring relative to the cylinder part. The main spring may be formed as a combination of coil spring 19 and flat spring 20 as shown in FIG. 1. The piston part includes a hollow piston 22 with sidewall 24 and crown 14.

The compressor electric motor is integrally formed with the compressor structure. The cylinder part includes motor stator 15. A co-acting linear motor armature 17 connects to the piston through a rod 26 and a supporting body 30. The linear motor armature 17 comprises a body of permanent magnet material (such as ferrite or neodymium) magnetised to provide one or more poles directed transverse to the axis of reciprocation of the piston within the cylinder liner. An end portion 32 of armature support 30, distal from the piston 22, is connected with the main spring.

The linear compressor 1 is mounted within the shell 2 on a plurality of suspension springs to isolate it from the shell. In use the linear compressor cylinder part will oscillate but because the piston part is made very light compared to the cylinder part the oscillation of the cylinder part is small compared with the relative reciprocation between the piston part and cylinder part.

An alternating current in stator windings 33, not necessarily sinusoidal, creates an oscillating force on armature magnets 17 to give the armature and stator substantial relative movement provided the oscillation frequency is close to the natural frequency of the mechanical system. This natural frequency is determined by the stiffness of the spring 19, and mass of the cylinder 10 and stator 15.

However as well as spring 19, there is an inherent gas spring, the effective spring constant of which, in the case of a refrigeration compressor, varies as either evaporator or condenser pressure (and temperature) varies. A control system which sets stator winding current and thus piston force to take this into account has been described in U.S. Pat. No. 6,809,434, the contents of which are incorporated herein by reference. U.S. Pat. No. 6,809,434 also describes a system for limiting maximum motor power to minimise piston cylinder head collisions based on frequency and evaporator temperature.

Preferably but not necessarily the control system of the present invention operates in conjunction with the control system disclosed in U.S. Pat. No. 6,809,434.

Figure 2:
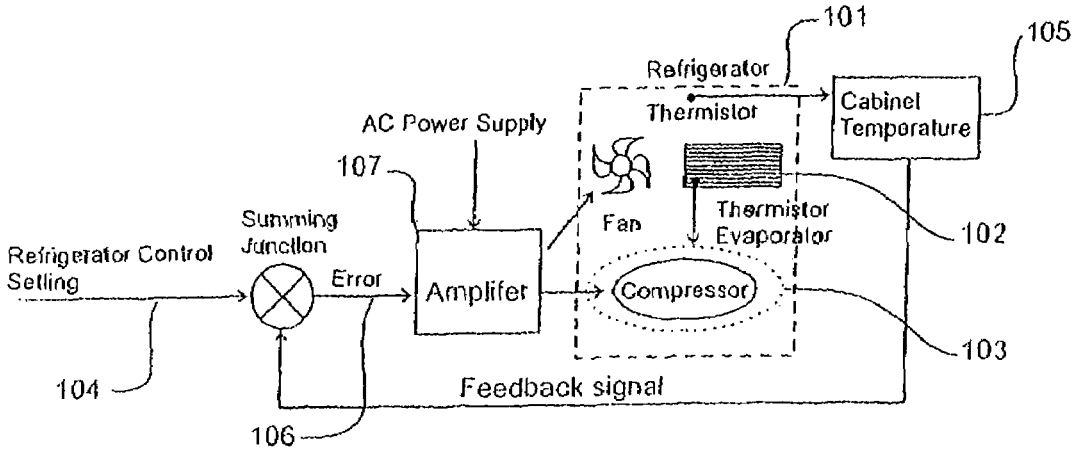
FIG. 2 shows a refrigerator control system in block diagram form.

To provide context for the linear compressor control system in the present invention a basic control system for a refrigerator is shown in FIG. 2. A refrigerator 101 incorporating an evaporator 102 and a compressor 103 is set by a user to operate at a desired cabinet temperature through a control which produces a signal 104. This causes compressor 103 to operate until the refrigerator cabinet temperature monitored by temperature sensor 105 indicates the desired temperature setting has been attained and the error signal 106 driving control amplifier 107 falls below a given threshold. At this point compressor 103 is switched off. When the cabinet temperature exceeds a predetermined threshold the magnitude of error signal 106 exceeds the predetermined value and the compressor is again turned on. This is the conventional non-linear feedback system used in refrigerators.

The control system of the present invention resides within the conventional loop described with reference to FIG. 2. It receives as an input the output signal from amplifier 107 and controls the compressor 103 which in the present invention will be a free piston linear compressor.

Figure 3:
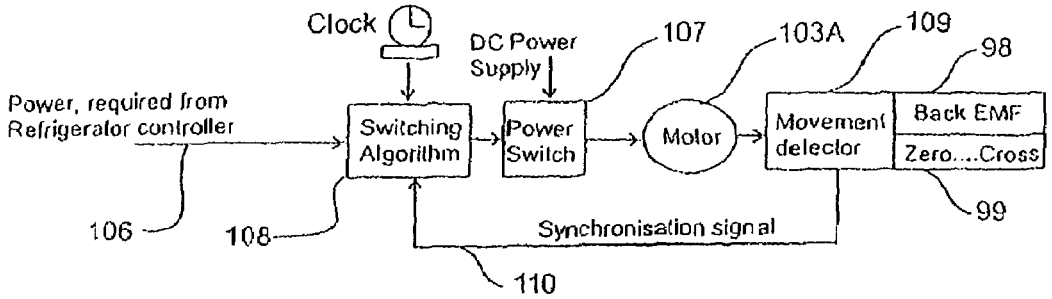
FIG. 3 shows a basic linear compressor control system using electronic commutation with switching timed from compressor motor back EMF.
Figure 4:
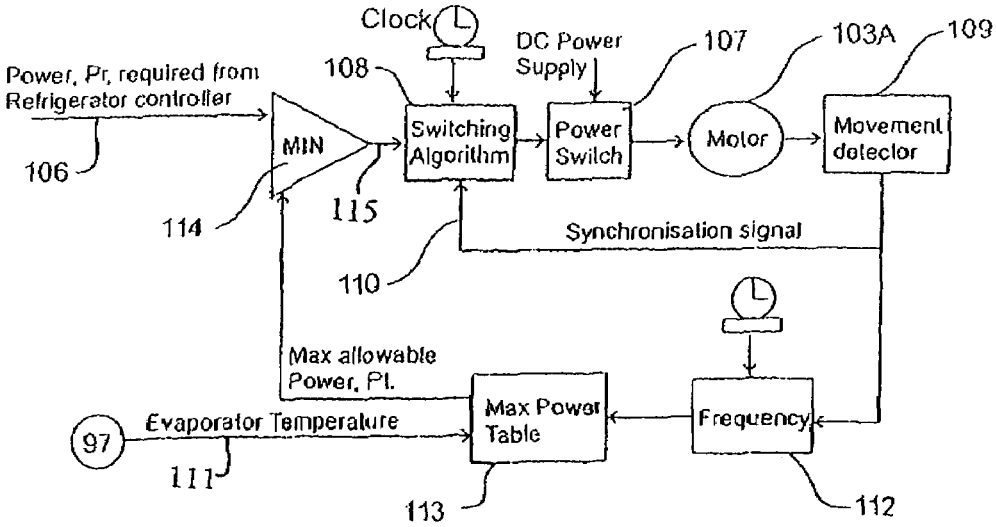
FIG. 4 shows the control system of FIG. 3 with piston collision avoidance measures.
Figure 7:
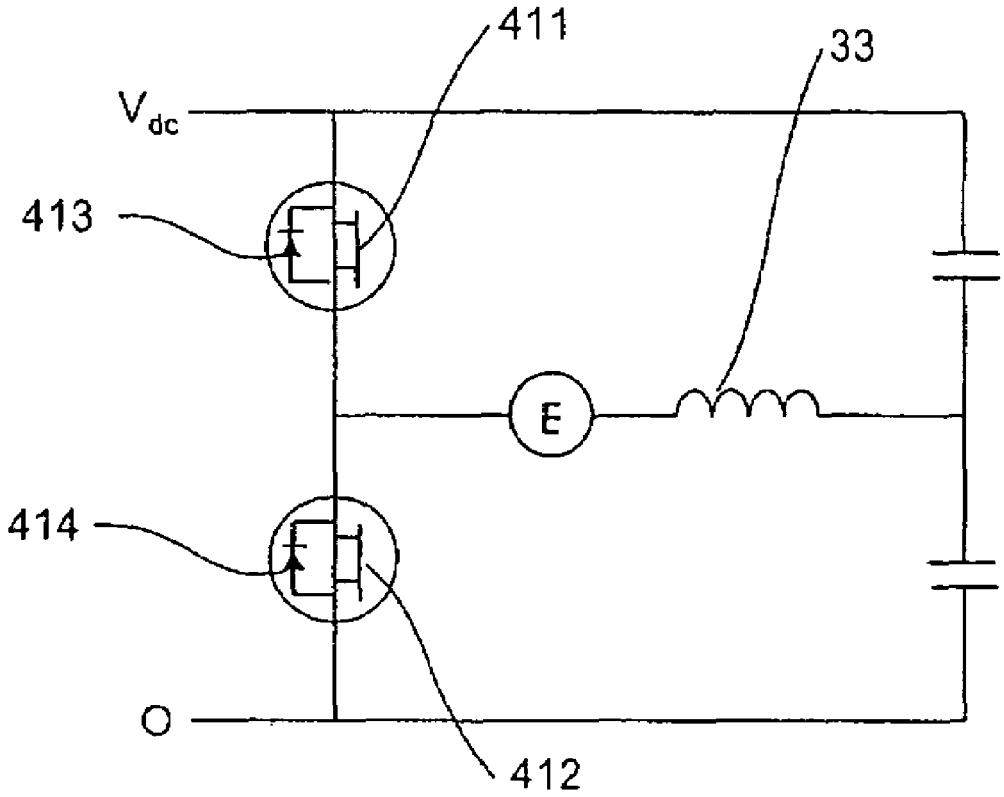
FIG. 7 shows a circuit for commutating current to the compressor windings.

The control system of the present invention operates in conjunction with the basic motor control system of FIG. 3 and preferably, although not necessarily with the system of FIG. 4. Referring to FIG. 3, linear compressor 103A, which may be of the type already described with reference to FIG. 1, has its stator windings energised by an alternating voltage supplied from power switching circuit 107 which may take the form of the bridge circuit shown in FIG. 7 which uses switching devices 411 and 412 to commutate current of reversing polarity through compressor stator winding 33. The other end of the stator winding is connected to the junction of two series connected capacitors which are also connected across the DC power supply. The "half" bridge shown in FIG. 7 may be replaced with a full bridge using four switching devices. The control system is preferably implemented as a programmed microprocessor controlling the operation of the power switching circuit 107. The switching circuit 107 is thus controlled by a switching algorithm 108 executed by the control system microprocessor. The microprocessor is programmed to execute various functions or use tables to be described which for the purposes of explanation are represented as blocks in the block diagrams of FIGS. 3 to 5.

Reciprocations of the compressor piston and the frequency or period thereof are detected by movement detector 109 which in the preferred embodiment comprises the process of monitoring the back EMF induced in the compressor stator windings by the reciprocating compressor armature and detecting the zero crossings of that back EMF signal. Switching algorithm 108 which provides microprocessor output signals for controlling the power switch 107 has its switching times initiated from logic transitions in the back EMF zero crossing signal 110. This ensures the reciprocating compressor peaks maximum power efficiency. The compressor input power may be determined by controlling either the current magnitude or current duration applied to the stator windings by power switch 107. Pulse width modulation of the power switch may also be employed.

FIG. 4 shows the basic compressor control system of FIG. 3 enhanced by the control technique disclosed in U.S. Pat. No. 6,809,434 which minimises piston/cylinder collisions in normal operation by setting a maximum power based on piston frequency and evaporator temperature. Output 111 from an evaporator temperature sensor is applied to one of the microprocessor inputs and piston frequency is determined by a frequency routine 112 which times the time between zero crossings in back EMF signal 110. Both the determined frequency and measured evaporator temperature are used to select a maximum power from a maximum power lookup table 113 which sets a maximum allowable power $P_t$ for a comparator routine 114. Comparator routine 114 receives as a second input value 106 representing the power demand ($P_r$) required from the overall refrigerator control. The comparator routine 114 is used by switching algorithm 108 to control switching current magnitude or duration. Comparator routine 114 provides an output value 115 which is the minimum of the power required by the refrigerator $P_r$ and the power $P_t$ allowed from maximum power table 113.

Using just the control concepts explained with reference to FIG. 4 will result in the linear compressor 103A (when active) operating with no or minimal piston collisions in normal operation. However as disclosed in U.S. Pat. No. 6,812,597 linear compressor 103A may be run in a "maximum power mode" where higher power can be achieved than with the FIG. 4 control system, but with the inevitability of some piston collisions. The control system of the present invention facilitates this mode as will now be described.

Figure 5:
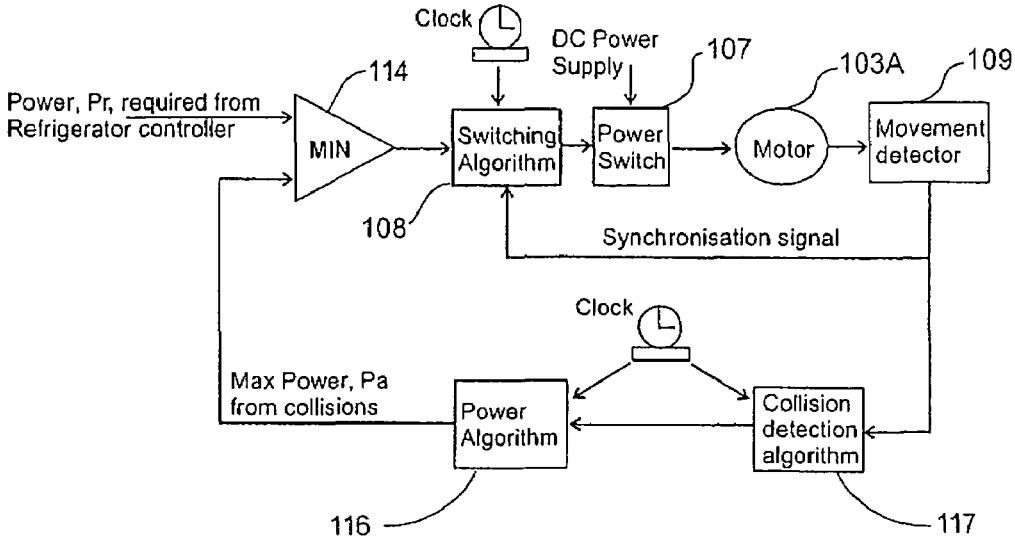
FIG. 5 shows the control system of FIG. 3 with collision control for high power operation of the compressor.

Referring to FIG. 5 a power algorithm 116 is employed which provides values to another input to comparison routine 114. Power algorithm 116 slowly ramps up the compressor input power by providing successively increasing values to comparator routine 114 which causes switching algorithm 108 to ramp up the power switch 107 current magnitude or preferably ON time duration. Power is increased to $P_a$+R every n cycles or piston reciprocations with $P_a$ being the power allowed by the collision analyser (see below) and R being a power increment which defines the ramp rate. In practice usually n=1. This ramping continues until a piston collision is detected. Collision detection process 117 is preferably determined from an analysis of the back EMF induced in the compressor windings and the technique used may be either that disclosed in U.S. Pat. No. 6,812,597, which looks for sudden decreases in piston period (FIGS. 8(*a*) and 8(*b*) show graphs of piston half-periods against time as mentioned below), or that disclosed in U.S. Pat. No. 10/880,389 which looks for discontinuities on the slope of the analogue back EMF signal.

Upon detection of a collision, power algorithm 116 causes a decremented value to be input to comparator routine 114 to achieve a decrease of power. Power algorithm 116 then again slowly ramps up the compressor input power until another collision is detected and the process is repeated.

Figure 6:
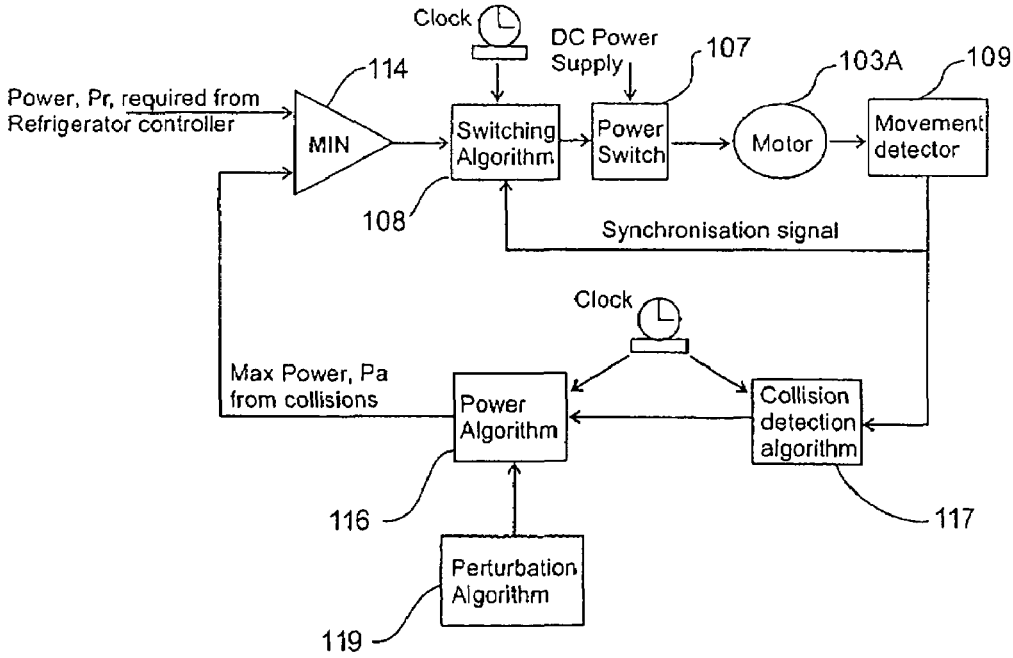
FIG. 6 shows the control system of FIG. 5 including perturbation of the compressor input power according to the present invention.
Figure 8A:
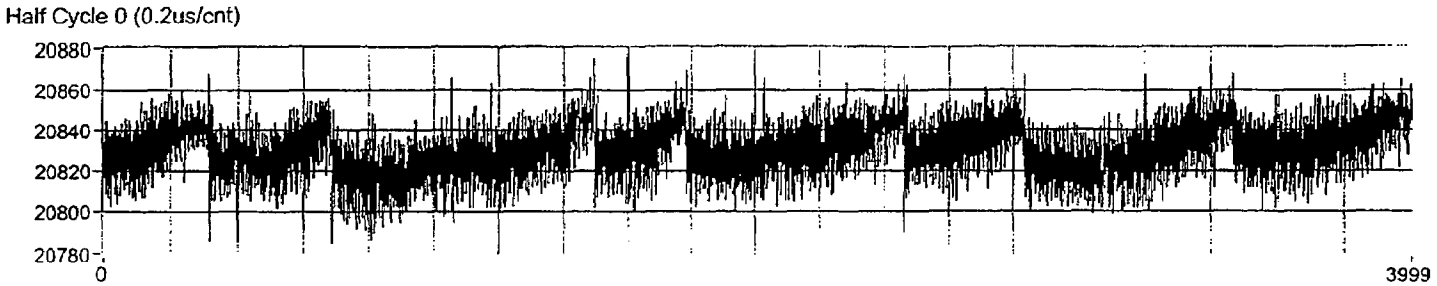
FIG. 8 shows a graph indicative of compressor power input illustrating the perturbated ramp function high power mode (and corresponding piston collisions), together with corresponding piston expansion and compression half cycle periods.
Figure 8B:
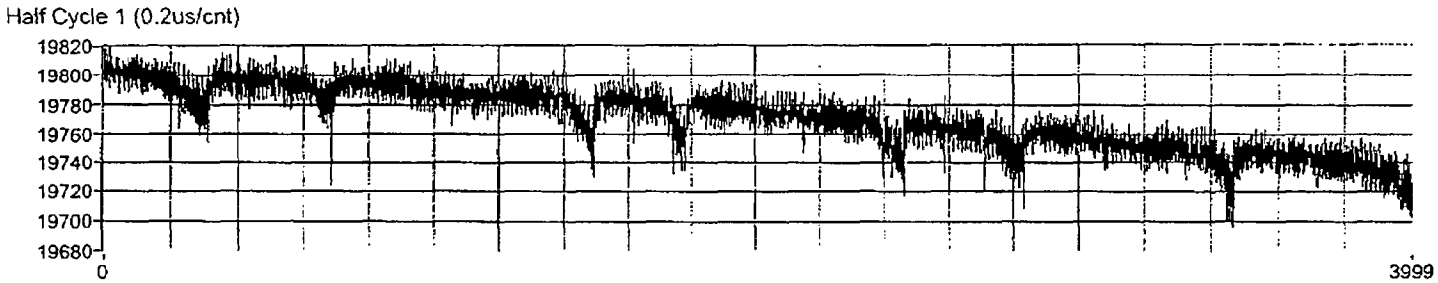
Figure 8C:
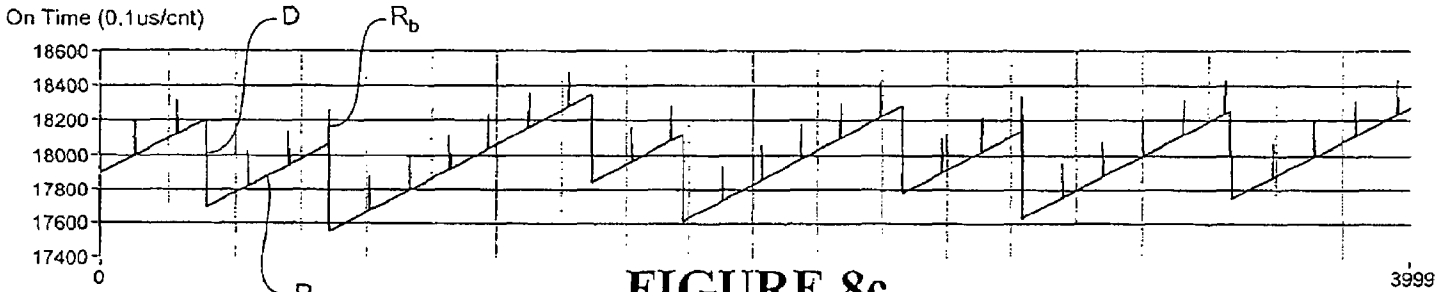

In order to maximise the probability of detecting the first collision due to increasing peak piston excursions (as continued collisions at what will be increasing power may cause damage) the effective power ramping signal provided by power algorithm 116 is periodically pulsed every m cycles by a perturbation algorithm 119 (see FIG. 6) with an increase ($R_p$) in power for a very short duration. A typical value of m might be 100. In one embodiment this is achieved by increasing the ON time of power switch 107 by 100 μs every 1 second (see FIG. 8(*c*)). Shorter increases in ON times, say 50 μs, could be used dependent on the collision detection system employed. This amounts to periodic application of an impulse function perturbation $R_p$ of the ramp signal as shown in FIG. 8(*c*), although it should be appreciated this is graph of power switch 107 ON time and not power as such. Every m cycles the power is increased to $P_a$+$R_p$ for one cycle, that is, for one reciprocation to induce a collision if compressor power is such as to nearly be causing peak piston displacements which result in collisions with the cylinder valve gear. This low energy collision is detected and compressor input power immediately reduced by s.$R_p$ where $_s$ might typically be 20, thus making the proven decrement 20 times the perturbation impulse power. The ramp function resumes to gradually increase compressor power again.

Using the perturbation technique described the linear compressor can be operated at maximum power and volumetric efficiency when required with low energy non-damaging piston collisions in the certainty that continued collisions at increasing power will be avoided.

Figure 9:
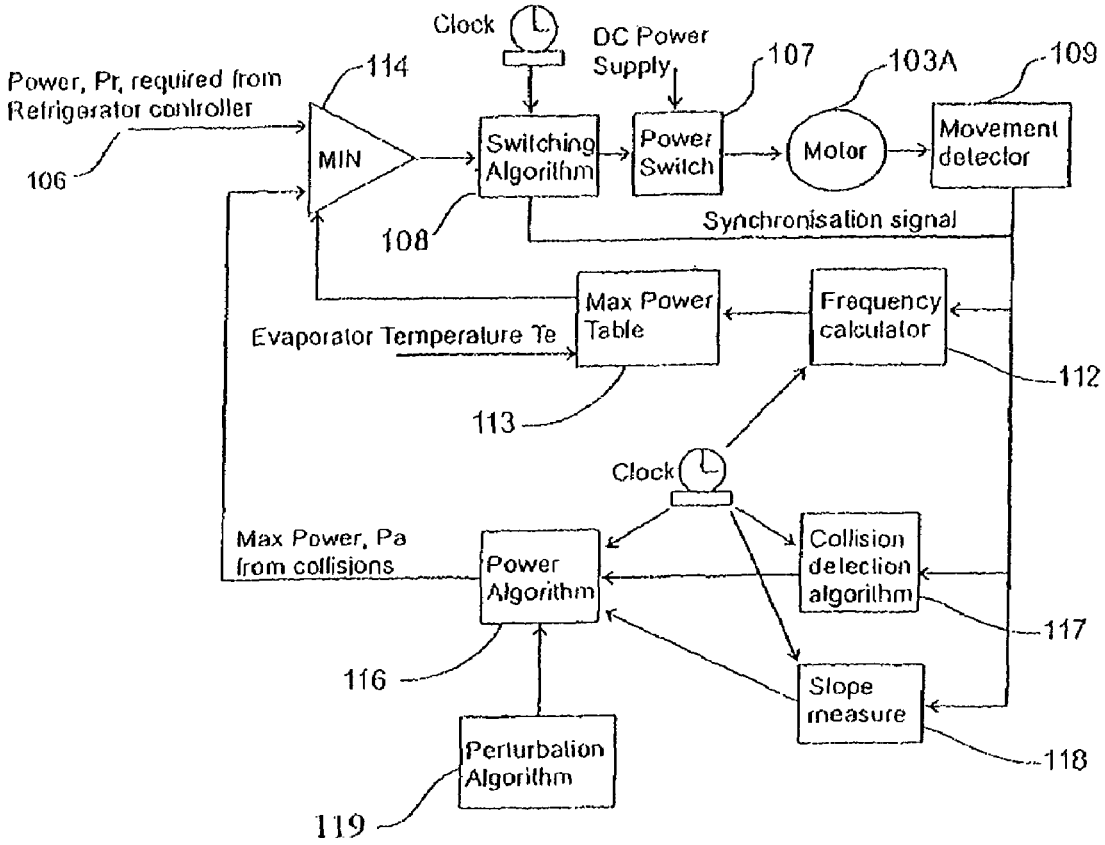
FIG. 9 shows a linear compressor control system incorporating all of the control features of FIGS. 3 to 6.

Desirably, but not necessarily the high power control methodology described is used in conjunction with control for normal operation where collision avoidance is employed as described with reference to FIG. 4. A control system employing both techniques is shown in FIG. 9. Here the comparison routine 114 receives three inputs, $P_r$, $P_t$ and $P_a$. In the system of FIG. 9 input $P_a$ from power algorithm 116 may be decremented by one or both of two collision detection processes 117 and 118. Process 117 looks for period change and process 118 looks for back EMF slope change as previously mentioned.

With such a comprehensive control system the operation may be summarised by tables I and II shown below.

TABLE I

Logic for normal running of the compressor where collision avoidance is the objective.

| Case | Situation | Description | Output |
|---|---|---|---|
| A | Normal running | Output power is the minimum of; 1- the power required by the refrigerator, Pr, 2- the power allowed by the Collision Table, Pt or 3- the power allowed by the Collision detector, Pa. | Pr |
| B | Collision Avoidance | If Pr > Pt then power is held at Pt. Where Pt is a function of Running Frequency and Evaporating Pressure (or temperature, as evaporating temperature is closely correlated to pressure) | Pt |
| C1 | Collision reaction | If a collision is detected power is decreased by about Rp | Pt − Rp or Pr − Rp |
| C2 | Frequent collisions | If there have been more than 1 collision in the last q cycles then decrease power by n × Rp | Pt − nRp or Pr − nRp |
| C3 | No collisions recently | If there has been no collisions in the last p cycles then increase Power by ΔP (this can continue until Power gets to its original value, Pt). | Pt − nRp + ΔP or Pr − nRp + ΔP |
| D | Safety net (only occurs for a severe collision that is undetected by the "collision detection" algorithm) | If at any time the back emf slope, S, exceeds the reference value, Sr, then the power is reduced to a minimal value, Pmin. | Pmin |

Definitions
Pr, Pa, Pt Power levels that are set by altering the commutation time
Rp Power step that reduces the power level.
n No of multiples of power change, normally n = 1
p No of cycles that must be collision free before Power is increased, normally p = 1,000,000
q No of cycles during the collision count, normally q = 10,000
Pmin A preset minimum power, normally about 20 W

TABLE II

Logic for high power running where low energy collisions are inherent.

| Case | Situation | Description | Output |
|---|---|---|---|
| A | Normal running | Output power is the minimum, of the power required by the refrigerator, Pr, and the power allowed by the Collision Analyser, Pa. | Pr |
| B | High Power | If Pr > Pa then power is increased to Pa + R every n cycles. After m cycles the power is increased to Pa + Rp for one cycle to produce a minor collision if a collision is imminent. | Pa + R or Pa + Rp |
| B1 | Collision reaction | If a collision is detected power is decreased by about s*Rp | Pa − s*Rp |
| B2 | Frequent collisions | If there have been more than 1 collision in the last q cycles then decrease R by δR (this can continue until R becomes a large negative number). | Pa + R − δR |
| B3 | No collisions recently | If there has been no collisions in the last p cycles then increase R by ΔR (this can continue until R gets to its original value). | Pa + R + ΔR |
| C | Safety net (only occurs for a severe collision that is undetected by the "collision detection" algorithm) | If at any time the back emf slope, S, exceeds the reference value, Sr, then the power is reduced to a minimal value, Pmin. | Pmin |

Definitions
Pr, Pa Power levels that are set by altering the commutation time
R Power increment that defines the "Ramp Rate"
Rp Power step that perturbates the power level to force a minor collision when the pump is running near its maximum stroke.
M No of cycles between each perturbation, normally m = 100
s Multiple that determines the power decrement after a collision, normally s = 20
p No of cycles that must be collision free before R is increased, normally p = 1,000,000
q No of cycles during the collision count, normally q = 10,000
Pmin A preset minimum power, normally about 20 W Preferably the collision detection algorithm is one derived from the ascertainment of a sudden decrease in piston period as disclosed in U.S. Pat. No. 6,812,597. An enhanced technique derived from this method will now be described.

The period of the oscillating piston 22 is made up of two half periods between bottom dead centre and top dead centre respectively, but neither successive or even alternate half periods are symmetrical. The half period expansion stroke when the piston moves away from the head (valve plate 5) is longer than the half period compression stroke when the piston moves towards the head. Further, because a linear compressor will often run with different periods in consecutive cycles (this becomes very significant if the discharge valve starts to leak), it is useful to separate the period times into odd and even cycles. Thus in the preferred method of piston collision detection four periods are stored and monitored; compression and expansion for the even cycles, plus compression and expansion for the odd cycles. Preferably a sudden change in either of the two shorter half cycles (compression strokes) is assumed in this method to indicate a piston collision. In FIG. 8(*b*) typical even short cycle periods are shown whereas FIG. 8(*a*) shows typical even expansion stroke half periods.

The process used in the preferred collision detection algorithm 117 is to store the back EMF zero crossing time intervals from detector 109 for the four half periods mentioned above as an exponentially weighted moving average (ewma) to give a smoothed or filtered value for each of the first and second half periods of the odd and even cycles. Preferably, an infinite impulse response (IIR) filter is used with weightings such that the outputted latest estimate of half period time is ⅛ of the last value+⅞ of the previous estimates. These estimates are continually compared with the detected period of the most recent corresponding half cycle and the comparison monitored for an abrupt reduction. If the difference exceeds an amount "A", algorithm 117 implies a collision. A value for the threshold difference "A" may be 20 microseconds. Other thresholds could be used, especially if the perturbation impulse energy is different from that resulting from a 100 μs ON time.

When a collision is detected the ON time of power switch 107 is reduced by (see for example transition D in FIG. 8(*c*)) to stop further collisions. In one embodiment the ON period is reduced by 51.2 μs to produce the previously mentioned $s.R_p$ decrement. Once the collisions stop, the ON time of power switch 107 is allowed to slowly increase to its previous value over a period of time (see the ramp function R in FIG. 8(*c*)). A value for the period of time for satisfactory operation may be approximately 1 hour. Of course, power control may be achieved by controlling current magnitude or by pulse width modulation to achieve the same effect as that described.

This is the high power mode of Table II. Alternatively the ON time will remain reduced until the system variables change significantly. In one embodiment where the system in U.S. Pat. No. 6,809,434 is used as the main current control algorithm, such a system change might be monitored by a change in the ordered maximum current. In that case it would be in response to a change in frequency or evaporator temperature. In the preferred embodiment the combination of that algorithm with a collision detection algorithm providing a supervisory role gives an improved volumetric efficiency over the prior art.

The invention claimed is:

1. A method of controlling a free-piston linear compressor comprising:

(a) providing a gradually increasing input power function to the compressor;

(b) superimposing a transient power function with the power function of step (a) to momentarily increase the input power to the compressor;

(c) monitoring for piston collisions; and (d) when a piston collision is detected immediately decrementing said input power.

2. A method according to claim 1, wherein the step of superimposing a transient power function is performed periodically.

3. A method according to claim 1, wherein steps (a) to (d) are repeated continuously during regular operation of the compressor.

4. A method of controlling a linear compressor which includes a free piston reciprocating in a cylinder driven by an electric motor having a stator with one or more excitation windings and an armature connected to said piston comprising the steps of:

(a) supplying an alternating current to said stator winding to cause said armature and piston to reciprocate, (b) obtaining an indicative measure of the reciprocation period of said piston, (c) detecting any sudden reduction of said indicative measure, said sudden reduction indicative of a piston collision with the cylinder head, (d) gradually increasing the power input to said stator windings over many reciprocation periods, (e) superimposing a transient increase in power with the gradually increasing stator power, and (f) reducing the power input to said stator windings on detecting any sudden decrease in piston period.

5. A method according to claim 4, wherein the step of superimposing a transient increase in power is performed periodically.

6. A method according to claim 4, wherein steps (d) to (f) are repeated continuously during operation of the compressor.

7. A method of controlling a linear compressor which includes a free piston reciprocating in a cylinder driven by an electric motor having a stator with one or more excitation windings and an armature connected to said piston comprising the steps of:

(a) supplying an alternating current to said stator winding to cause said armature and piston to reciprocate, (b) monitoring the motor back EMF, (c) detecting zero-crossings of said motor back EMF, (d) monitoring the slope of the back EMF waveform in the vicinity of said zero-crossings, (e) detecting discontinuities in said waveform slope, said discontinuities indicative of a piston collision with the cylinder head, (f) gradually increasing the power input to said stator windings over many reciprocation periods, (g) superimposing a transient increase in power with the gradually increasing stator power, and (h) reducing the power input to said stator windings on detecting any back EMF slope discontinuity.

8. A method according to claim 7, wherein the step superimposing a transient increase in power is performed periodically.

9. A method according to claim 7, wherein steps (d) to (f) are repeated continuously during regular operation of the compressor.

10. A free piston gas compressor comprising:

a cylinder, a piston, said piston reciprocable within said cylinder, a reciprocating linear electric motor coupled to said piston, a control system configured to monitor motor back EMF for an indication of piston collisions and set the power input to said motor accordingly, said control system gradually increasing the power input to said motor in the absence of piston collisions and rapidly reducing the power input to said motor if a collision is detected, in the absence of piston collisions said control system superimposing transient power increases with said gradually increasing power input to induce a lower energy collision when said piston is near maximum displacement.

11. A free piston gas compressor according to claim 10 wherein said control system monitors a time interval between consecutive back EMF zero crossing to determine a reciprocation half cycle period, a sudden reduction in the reciprocation half cycle period providing said indication of piston collisions.

12. A free piston gas compressor according to claim 10 wherein said control system monitors the slope of the back EMF waveform in the vicinity of zero-crossings and detects discontinuities in said waveform slope, said discontinuities providing said indication of piston collisions.

13. A free piston gas compressor comprising:

a cylinder, a piston reciprocally received within the cylinder, an electric motor coupled to the piston, and a control system configured to control reciprocation of the piston by:

(a) gradually increasing input power to the electric motor to cause the piston to reciprocate with increasing displacement;

(b) superimposing a transient increase in power with the gradually increasing input power of step (a) to momentarily increase piston displacement;

(c) monitoring piston collisions, and (d) when a piston collision is detected immediately decrementing said input power.

14. A free piston gas compressor according to claim 13 wherein said motor is an electronically commutated permanent magnet DC linear reciprocating motor.

15. A free piston gas compressor according to claim 13 wherein input power to the electric motor is increased by a power switching device, said control system determining the power input to the motor by controlling the ON time of said switching device during reciprocation of the piston.

16. A free piston gas compressor according to claim 13 wherein said control system determines piston collisions by:

monitoring a back EMF induced in an excitation winding of the electric motor when current is not flowing;

determining back EMF zero crossings and timing an interval between consecutive zero crossings to determine a duration of each reciprocation half cycle; and monitoring the duration of each reciprocation half cycle to determine any sudden reductions in piston reciprocation period indicative of a piston collision.

17. A free piston gas compressor according to claim 15 wherein said control system increases the ON time of said switching device by a predetermined transient amount at periodic intervals equal to a multiple of the reciprocation period to momentarily increase piston displacement in accordance with step (b).

18. A free piston gas compressor according to claim 16 wherein said control system averages the times of alternate reciprocation half cycles and compares the most recent measured reciprocation half cycle with the average reciprocation half cycles time to provide a difference value, said control system determining if said difference value is above a predetermined threshold for a predetermined period.

19. A refrigerator comprising a free piston gas compressor according to claim 16 and an evaporator, said control system of said compressor determining a reciprocation frequency of said piston and said refrigerator including a temperature sensor which senses the temperature at the evaporator, a maximum compressor input power being determined as a function of reciprocation frequency and evaporator temperature.

20. A refrigerator according to claim 19 wherein said control system monitors the slope of the back EMF waveform in the vicinity of zero-crossings and detects discontinuities in said waveform slope, said discontinuities indicative of a piston collision with the cylinder head, said control system also reducing power to said excitation winding in response to detecting any back EMF slope discontinuity.

* * * * *